US005459554A

United States Patent [19]

Shiraishi

[11] Patent Number: 5,459,554

[45] Date of Patent: Oct. 17, 1995

[54] IMAGE-FORMING APPARATUS FOR FORMING AN IMAGE AT A PLURALITY OF IMAGE-FORMING CONDITIONS

[75] Inventor: Hiroyuki Shiraishi, Kanagawa, Japan

[73] Assignee: Kabushiki Kaisha Toshiba, Kawasaki, Japan

[21] Appl. No.: 288,735

[22] Filed: Aug. 12, 1994

[30] Foreign Application Priority Data

Sep. 22, 1993 [JP] Japan ..... 5-236965

[51] Int. Cl.[6] ..... G03G 21/00

[52] U.S. Cl. ..... 355/204; 355/206; 355/208; 355/209

[58] Field of Search ..... 355/203, 204, 355/206, 208, 209, 210, 77; 377/39

[56] References Cited

U.S. PATENT DOCUMENTS 4,044,232 8/1977 Hubbard ..... 377/8
4,542,985 9/1985 Honma et al. ..... 355/208 X
5,270,779 12/1993 Kawai ..... 355/206 X
5,311,257 5/1994 Ishii et al. ..... 355/209
5,390,005 2/1995 Kimoto et al. ..... 355/209

*Primary Examiner*—Sandra L. Brase
*Attorney, Agent, or Firm*—Foley & Lardner

[57] ABSTRACT

An image-forming apparatus for forming an image at one of a plurality of image-forming conditions, including a standard condition, includes an image-forming unit; input keys coupled to the image-forming unit; a controller coupled to the input keys, the controller determines one of the image-forming conditions corresponding to the operation of the input keys; a timer coupled to the controller, the timer outputting a predetermined signal when a predetermined time has elapsed after the operation so as to make the controller change the image-forming condition to the standard condition; and a prohibit key coupled to the controller, to prevent the controller from changing to the standard condition.

16 Claims, 15 Drawing Sheets

IMAGE-FORMING APPARATUS FOR FORMING AN IMAGE AT A PLURALITY OF IMAGE-FORMING CONDITIONS

BACKGROUND OF THE INVENTION

1. Field of the Invention

The present invention relates to an image-forming apparatus which is capable of being set at a plurality of image-forming conditions. More specifically, the invention relates to an image-forming apparatus with a so-called automatic resetting function in which a voluntary image-forming condition is automatically changed to a standard condition in accordance with the time elapsed.

2. Description of the Related Art

Recently, many image-forming apparatuses, e.g., plain paper copying machines, have an automatic resetting function, as disclosed in U.S. Pat. No. 4,044,232.

The automatic resetting function is useful for operators. Because, if a standard condition is predetermined as a condition in which a majority of operators use the image-forming apparatus, there is no need for a subsequent operator to reset the operating condition even if a previous operator has not reset a voluntary condition which he set and has left.

However, if an operator takes too much time to set an original onto an original table after he set at a voluntary condition, the image-forming condition is changed to the standard condition irrespective of his will. In this case, because the operator must select the voluntary condition again, the automatic resetting function causes an obstruction.

SUMMARY OF THE INVENTION

It is therefore an object of the present invention to provide an improved image-forming apparatus.

It is a particular object of the present invention to provide an image-forming apparatus with a more useful automatic resetting function which is prevented from being reset to a standard condition while an operator is setting an original.

Another object of the present invention is to provide an improved image-forming method.

In accordance with one aspect of the present invention, the foregoing objects, among others, are achieved by providing an image-forming apparatus for forming an image in one of a plurality of image-forming conditions including a standard condition, comprising: means for forming an image on an image-bearing member in one of a plurality of image-forming conditions; means for setting a voluntary condition which is one of the image-forming conditions; means for changing the voluntary condition to the standard condition when a predetermined time has elapsed after the setting; and means for preventing the voluntary condition from changing to the standard condition.

In accordance with another aspect of the present invention, there has been provided an image-forming apparatus for forming an image in one of a plurality of image-forming conditions including a standard condition, comprising: an image-forming unit; input keys coupled to the image-forming unit, a controller coupled to the input keys, wherein the controller determines one of the image-forming conditions corresponding to the operation of the input keys; a timer coupled to the controller, the timer outputting a predetermined signal when a predetermined time has elapsed after the operation of the input keys so as to make the controller change the image-forming condition to the standard condition; and a prohibit key coupled to the controller, to prevent the controller from changing to the standard condition.

In accordance with still another aspect of the present invention, there has ben provided an image-forming method for forming an image corresponding to an original positioned at an image-reading position at one of a plurality of image-forming conditions including a standard condition, comprising the steps of: setting a voluntary condition which is one of the image-forming conditions; changing the voluntary condition to the standard condition when a predetermined time has elapsed after the setting; preventing the image forming condition from changing to the standard condition at least while the original is positioned at the image-reading position; and forming an image on an image-bearing member at one of the plurality of image-forming conditions.

BRIEF DESCRIPTION OF THE DRAWINGS

A more complete appreciation of the present invention and many of the attendant advantages thereof will be readily obtained as the invention becomes better understood by reference to the following detailed description, when considered in connection with the accompanying drawings, wherein.

DETAILED DESCRIPTION OF THE PREFERRED EMBODIMENT

Figure 1:
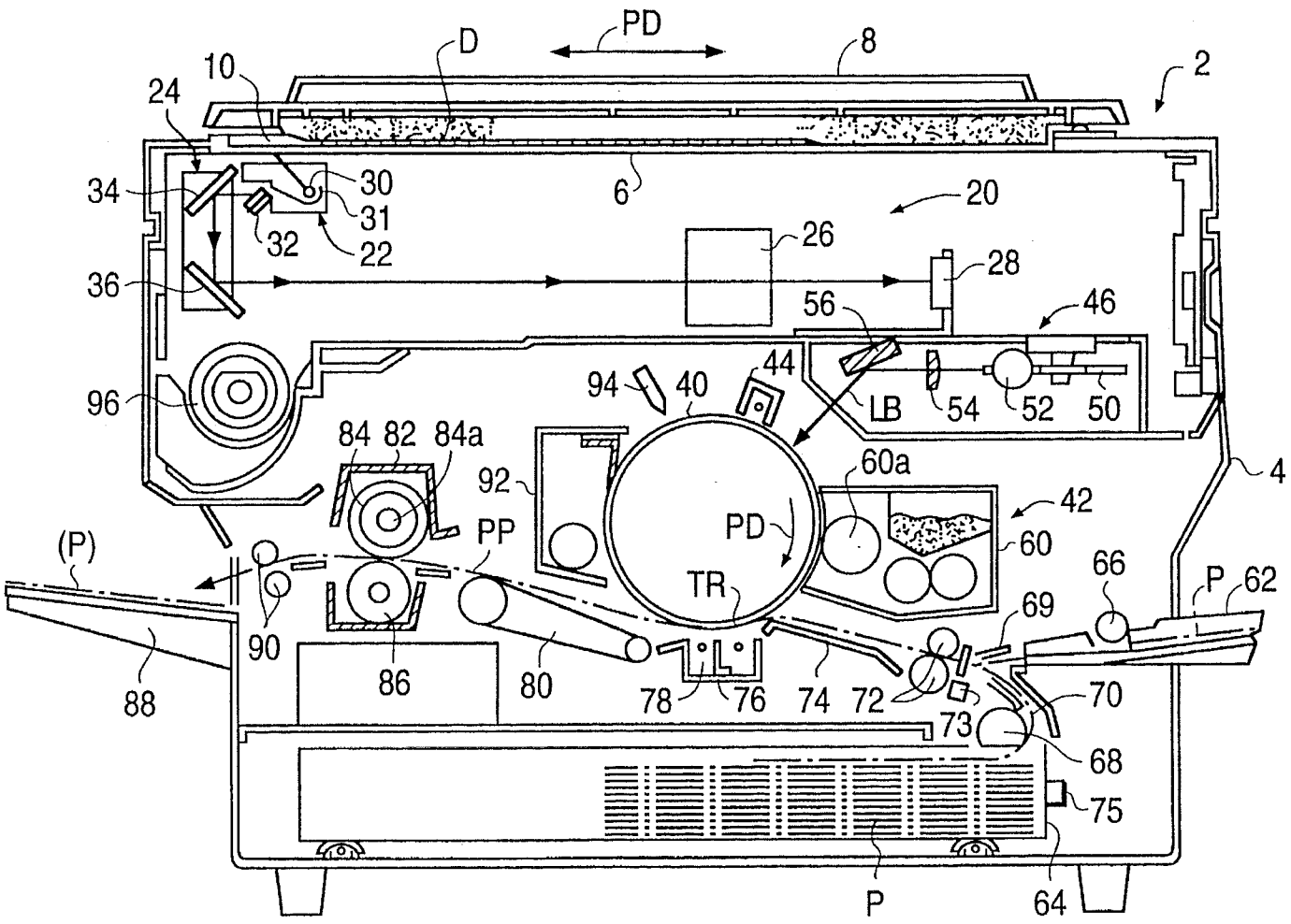
FIG. 1 is a sectional view of the image-forming apparatus of a first embodiment of the present invention.
Figure 2:
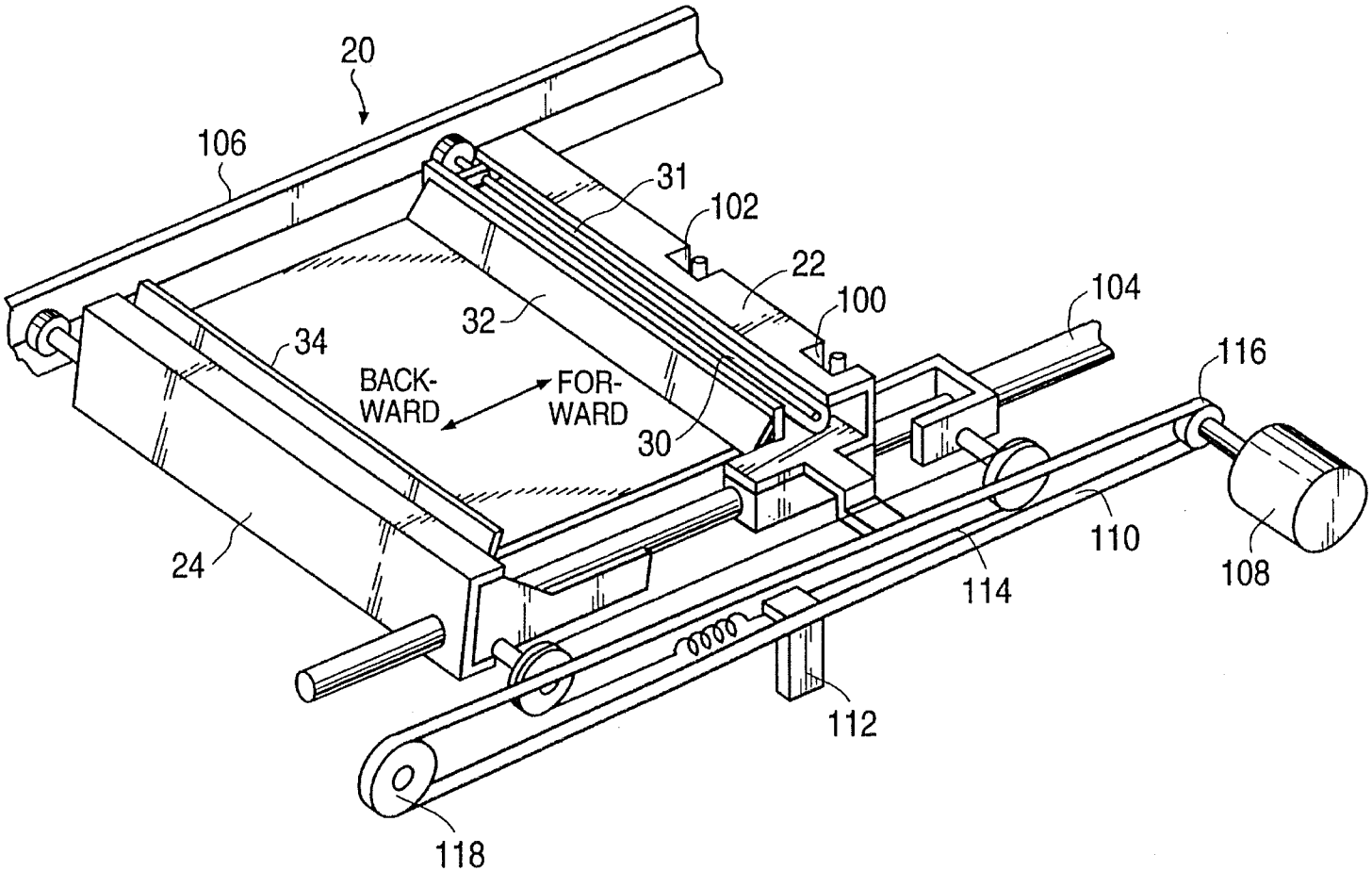
FIG. 2 is a perspective view schematically showing a construction of an image-reading section of the image-forming apparatus shown in FIG. 1.

FIG. 1 shows a copying machine 2 as an image-forming apparatus according to a first embodiment of the present invention. Copying machine 2 includes a copying machine housing 4. An original table 6 which is a transparent glass is fixed on the upper surface of housing 4. An openable original cover 8 is arranged near original table 6. A fixed scale 10 for indicating placement positions for positioning an original D is arranged at one end of original table 6 along the longitudinal direction thereof.

Original D placed on original table 6 is scanned for image exposure by an image-reading system 20. Image-reading system 20 includes a first carriage 22, a second carriage 24, a lens block 26 for magnification and reduction and for focusing the light from original D, and a CCD sensor 28. First carriage 22 includes an exposure lamp 30, a reflector 31 for reflecting the light from exposure lamp 30 to original table 6, a mirror 32 and an original detector for detecting original D described later. Second carriage 24 includes a mirror 34 and a mirror 36. First carriage 22 and second carriage 24 are transported by a pulse motor (not shown), through a driving belt and some gears (not shown). Therefore, when image-reading system 20 scans original D, original D is exposed by exposure lamp 30 while first carriage 22 and second carriage 24 reciprocate in the direction indicated by an arrow PP along the under surface of original table 6. In this case, second carriage 24 moves at a speed half that of first carriage 22 in order to maintain a fixed optical path length.

A reflected light beam from original D scanned by image-reading system 20 is reflected by mirror 32, mirror 34 and mirror 36, transmitted through lens block 26 and then led to CCD sensor 28. CCD sensor 28 outputs electric signals corresponding to the reflected light beam indicating the original image of original D.

A photosensitive drum 40 is surrounded by an image-forming unit 42. Photosensitive drum 40 is rotated by a motor (not shown) in the direction indicated by an arrow PD so that its surface is wholly charged by a main charger 44. Therefore, the potential of the circumferential surface of photosensitive drum 40 is about −750 V. A laser beam LB is projected on the charged surface of photosensitive drum 40 by a laser unit 46, forming the electrostatic latent image. Laser unit 46 including a semiconductor laser oscillator (not shown) for generating laser beam LB modulated in accordance with dot image data on the basis of the electric signal output from CCD sensor 28. Also, laser unit 46 includes a collimator lens for focussing laser beam LB emitted from the laser oscillator so that a section shape of laser beam LB is circular, a polygon mirror 50 for scanning laser beam LB focused by the collimator lens, a mirror motor 52 for rotating polygon mirror 50 at a high speed, an fθ lens 54 to unify the focussing condition of the laser beam in the scanning direction, and a mirror 56 for reflecting laser beam LB so that laser beam LB is radiated onto photosensitive drum 40.

The electrostatic latent image is developed into a visible image which is a toner image by a develop roller 60*a* of a developing unit 60 using a two component developing agent. A bias voltage of developing unit 60 is about −500 V. Paper sheets P as an image record media are delivered one by one from a paper tray 62 or a paper cassette 64 by paper-supply roller 66 or paper-supply roller 68, and guided along a paper guide path 69 or a paper guide path 70 to an aligning roller pair 72. Paper sheet P is detected by an aligning switch 73 directly upstream of aligning roller pair 72 in the transportation direction of paper sheet P. Then, each paper sheet P is delivered to a transfer region TR by aligning roller pair 72 and a guide 74, timed to the formation of the visible image.

Paper cassette 64 is removably attached to the bottom portion of housing 4. Paper cassette 64 and paper tray 62 can be alternatively selected by operation on a control panel described later. Paper cassette 64 is provided, respectively, with cassette size detecting switches 75 which detect the size of paper sheet P in paper cassette 64. Detecting switches 75 are each formed by a plurality of microswitches which are turned on or off in response to insertion of cassettes which have different sizes of paper sheet P.

Paper sheet P delivered to transfer region TR comes into intimate contact with the surface of photosensitive drum 40, in the space between a transfer charger 76 which is a DC corona discharger and photosensitive drum 40. As a result, the toner image on photosensitive drum 40 is transferred to paper sheet P by the agency of transfer charger 76. After the transfer, paper sheet P is separated from photosensitive drum 40 by a separation charger 78 which is a vibratory (AC and DC) corona discharger and transported by a conveyor belt 80. Separation charger 78 removes the electrostatic force supplied between photosensitive drum 40 and paper sheet P in order to separate the paper sheet from photosensitive drum 40. Thus, paper sheet P is delivered to a fixing unit 82 arranged at the terminal end portion of conveyor belt 80 along a paper path PP. Fixing unit 82 includes a heat roller 84 which has a heater lamp 84*a* and a pressure roller 86 which is arranged in contact with heat roller 84. As paper sheet P passes a nip portion between heat roller 84 and pressure roller 86, the transferred image is fixed on paper sheet P. After the fixation, paper sheet P is discharged into a tray 88 outside housing 4 by a rotation of an exit roller pair 90.

After the transfer, moreover, the residual toner on the surface of photosensitive drum 40 is removed by a cleaner 92. Thereafter, a residual latent image on photosensitive drum 40 is erased by a discharge lamp 94 to restore the initial state. A cooling fan 96 for preventing the temperature inside housing 4 from rising is arranged at upper-left portion of fixing unit 82.

The construction of the image-reading system including the original detector will now be described in detail.

First carriage 22 includes a first sensor 100 and a second sensor 102. First sensor 100 detects the size of original D when copying machine 2 is in a mode which requires detection of the size of original D. Second sensor 102 detects that original D is placed on original table 6 which is an image-reading portion. Second sensor 102 also detects the size of original D with first sensor 100 when copying machine 2 is in a mode which requires detection of the size of original D. Second sensor 102 is arranged at the central area of first carriage 22 corresponding to the central area of original table 6. According to copying machine 2, the placement and the size of original D are detected, with original cover 8 unfolded. The first sensor 100 and second sensor 102 are light modulation type reflection sensors, which include a light-emitting element for emitting pulse-modulated light and a light-receiving element which receives only the pulse-modulated light emitted from the light-emitting element.

First carriage 22 and second carriage 24 are moveable along a guide shaft 104 and a guide rail 106. First carriage 22 and second carriage 24 are driven by a scanning motor 108, which is a pulse motor. First carriage 22 and second carriage 24 are moved forward and backward by a mechanism including a driving belt 110, a wire-fixing portion 112, and a wire 114. Driving belt 110 is stretched between, and wound around a first pulley 116 and a second pulley 118.

When copying machine 2 is in a stand-by state, first carriage 22 is positioned at one end of original table 6, as shown in FIG. 1, so that second sensor 102 is positioned adjacent to the edge of original table 6 which is the closest to fixed scale 10. When original D is placed on original table 6 so that the center line of original D coincides with the center line of original table 6, second sensor 102 detects the presence of original D on original table 6. At that time, if copying machine 2 is in a mode which requires detection of the size of original D, first carriage 22 is moved forward and first sensor 100 and second sensor 102 detect the size of original D on the basis of the light received by the light-receiving elements.

Figure 3:
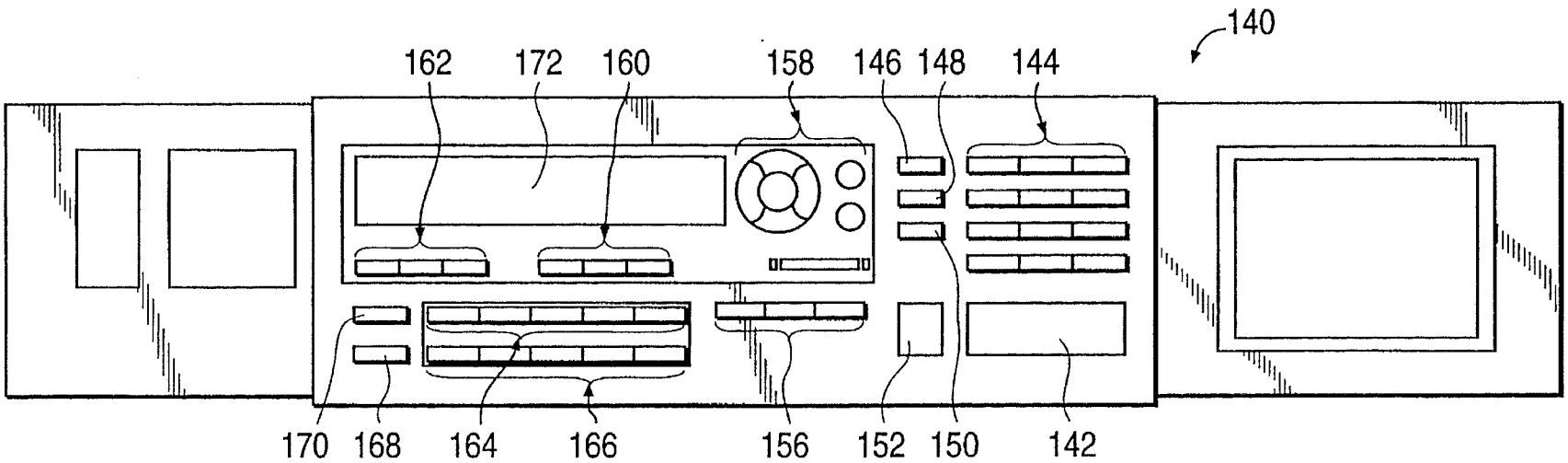
FIG. 3 is a plan view of a control panel of the image-forming apparatus shown in FIG. 1.

As mentioned above, it is possible to set copying machine 2 in a plurality of operating modes. Also, the mode of operation of copying machine 2 may be changed from a standard status to a voluntary status. The setting and the changing are performed by operation of a central panel 140 as shown in FIG. 3.

Control panel 140 is mounted on housing 4. Control panel 140 carries thereon a copy key 142 for starting the copying operation, keys 144 for setting the number of copies to be made and the like, a function clear key 146 for setting the standard status, an energy saver key 148 for going into the energy-saving mode and turning all display lamps off, an interrupt key 150 for making a copy of a different original during a multicopy run, and a clear/stop key 152 for clearing the copy quantity entered or stopping a multicopy run. Control panel 140 is further provided with a density setting section 156 for setting the copy density, an editing key 158 for setting the trimming mode or masking mode and modifying characters, operation guide keys 160 including "YES" key, "NO" key, and "HELP" key, for asking for the appropriate operation procedure and answering questions from copying machine 2, zoom keys 162 for adjustably setting the enlargement or reduction ratio, an original size key 164 for setting an original size, a copy size key 166 for selecting the paper sheet size, an automatic paper selection key 168 for automatically detecting the size of the original set on original table 6 and selecting a paper sheet of the same size as the original, an automatic magnification selection key 170 for automatically detecting the size of the original D set on original table 6 and calculating the correct reproduction or enlargement ratio, and a display section 172 for indicating the operating conditions of the individual parts.

Copying machine 2 performs the copying operation on the basis of the copying status and the copying mode set by the operation of control panel 140. The copying operation is controlled by a control system 200 which will be described.

Figure 4:
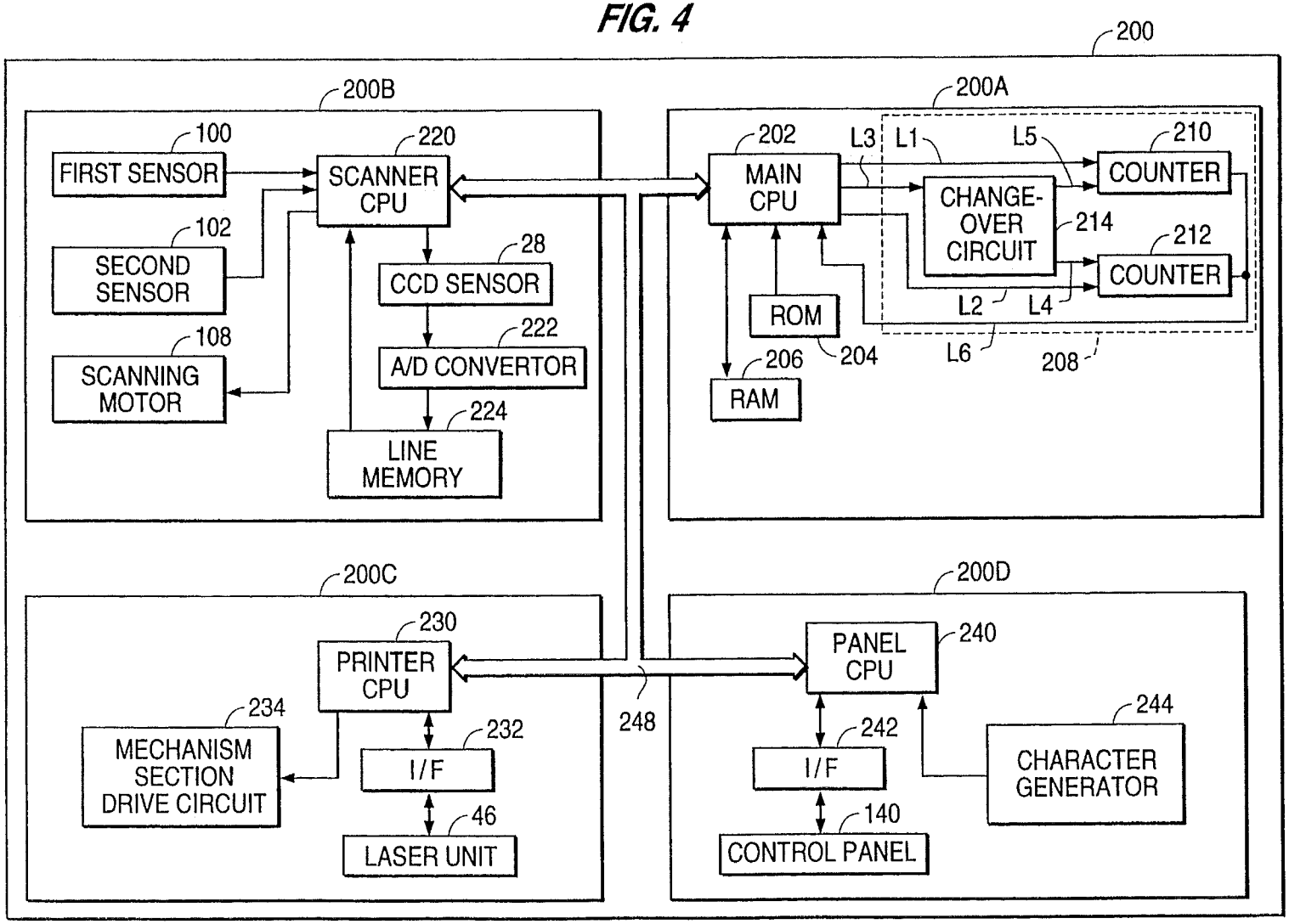
FIG. 4 is a diagram showing a control system of the image-forming apparatus shown in FIG. 1.

Referring to FIG. 4, control system 200 has a main control section 200A, a reading control section 200B for controlling image-reading system 20, an image-forming control section 200C for controlling image-forming unit 42, and an input control section 200D.

Main control section 200A includes a main CPU 202 which controls entire control system 200. A ROM 204 stores a control program. CPU 202 operates in accordance with the control program in ROM 204. A RAM 206 is used as a page buffer for temporarily storing image data formed by image-reading section 20, and as a work buffer of main CPU 202. A timer 208 connects to main CPU 202. Timer 208 determines that a predetermined time has elapsed after the last setting operation of control panel 140, and outputs a signal to main CPU 202. When main CPU 202 receives the signal, main CPU 202 changes the copying status and the copying mode to the standard status. Timer 208 includes a counter 210, a counter 212, a change-over circuit 214, and lines L1 to L6 for transmitting signals. Counter 210 operates when original D is placed on original table 6. Counter 212 operates when original D is not placed on original table 6. Counter 210 and counter 212 are switched by change-over circuit 214 and operate independently. The preset amounts of counter 210 and counter 212 are set by main CPU 202. These preset amounts are stored in the RAM 206. It is possible to change these preset amounts by the operation of control panel 140 described later.

Reading control section 200B includes a scanner CPU 220 which controls reading control section 200B. CCD sensor 28, first sensor 100, second sensor 102, and scanning motor 108 are connected to scanner CPU 220. An A/D convertor 222 connects to the output portion of CCD sensor 28. A line memory 224 connects to scanner CPU 220 and A/D convertor 222. A/D convertor 222 outputs a signal containing digital image data corresponding to electric signals which CCD sensor 28 outputs. The digital image data output by A/D convertor 222 is temporarily stored in line memory 224 and is sent to RAM 206 through scanner CPU 220 and main CPU 202.

Image-forming control section 200C includes a print CPU 230 which controls image-forming unit 42 (FIG. 1). Laser unit 46 connects to printer CPU 230 through an interface circuit 232 (FIG. 4). The image data stored in RAM 206 is sent to printer CPU 230 through main CPU 202. Printer CPU 230 modulates laser beam LB in accordance with the image data when the semiconductor laser oscillator generates the laser beam. Printer CPU 230 connects to a mechanism section drive circuit 234 which is provided with drive circuits for driving various types of motors and solenoids in relationship with image-forming unit 42.

Input control section 200D includes a panel CPU 240 which controls control panel 140. Control panel 140 connects to panel CPU 240 through an interface circuit 242. Panel CPU 240 connects to a character generator 244 for generating data for characters which are displayed on display section 172. Main CPU 202, scanner CPU 220, printer CPU 230, and panel CPU 240 are connected to one another by a data bus 248.

Figure 5A:
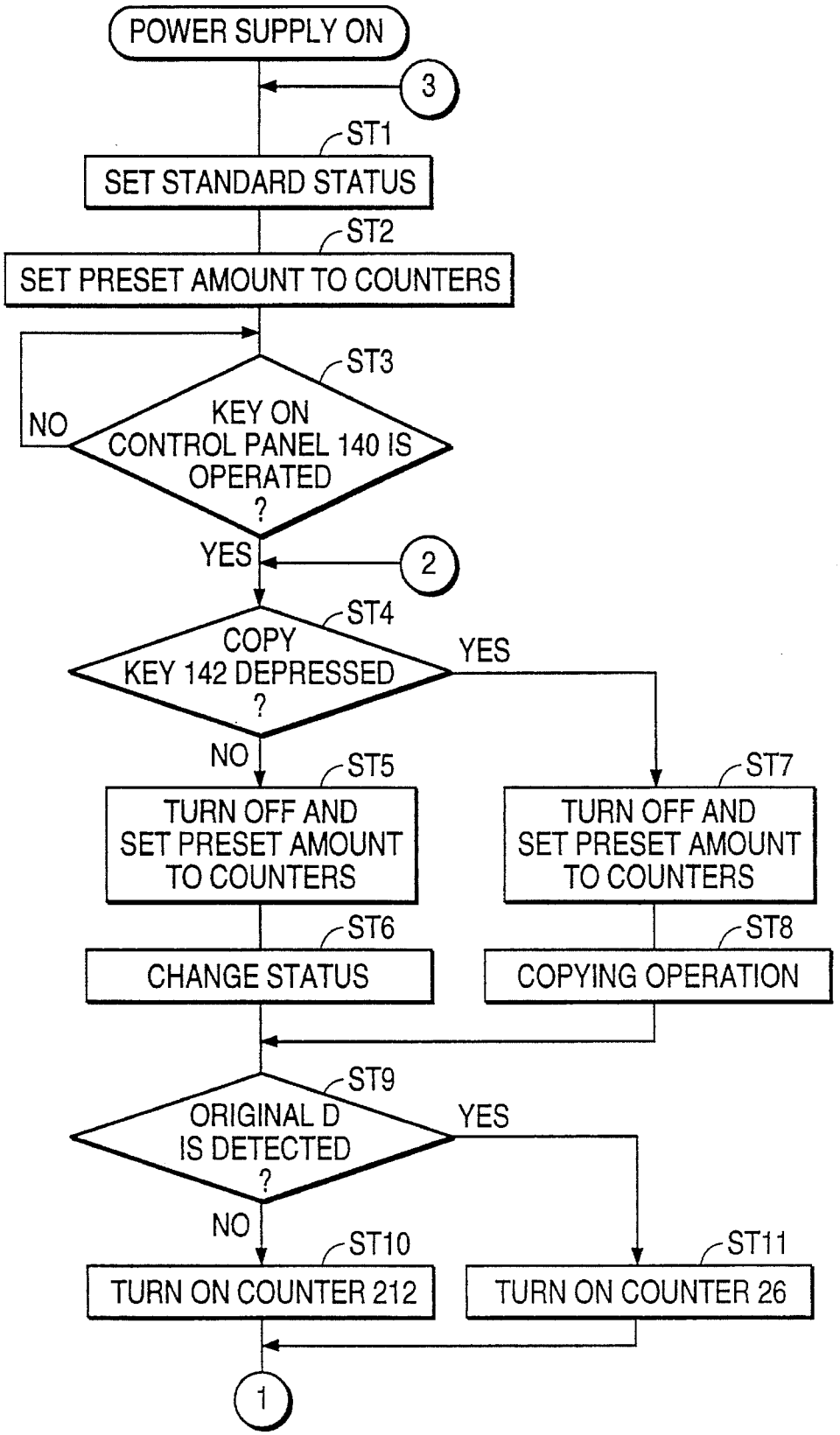
FIGS. 5(*a*) and 5(*b*) are flow charts for illustrating the operation of the control system shown in FIG. 4.
Figure 5B:
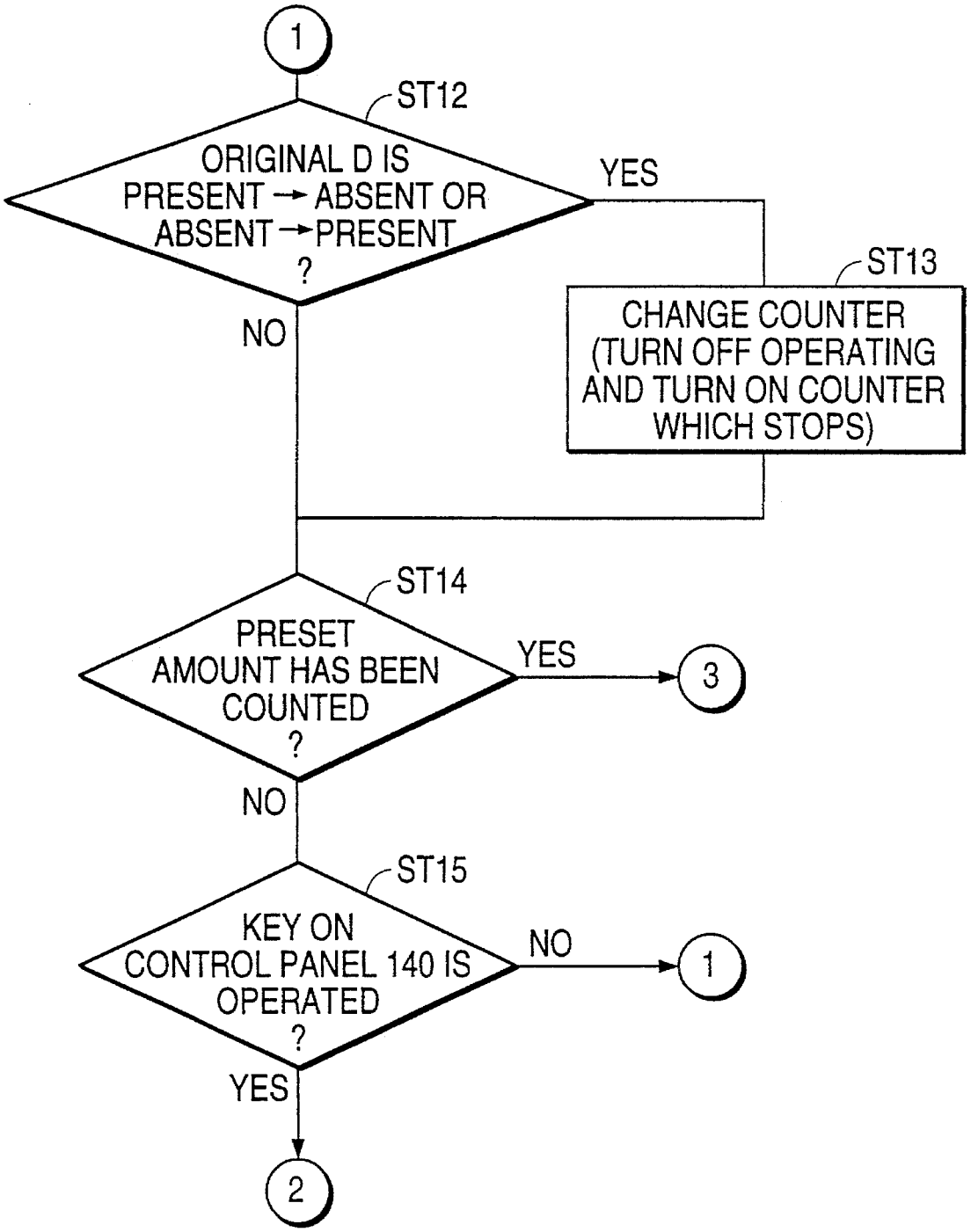

Operation of control system 200 will be described below with reference to flow charts shown in FIGS. 5(*a*) and 5(*b*).

When a power supply (not shown) is turned on, main CPU 202 sets the standard status (step ST 1). In the standard status, the number of copies is one; the density is medium; the timing mode, the masking mode, and the modification of characters are not set; the size ratio between the original image and the copy image is 100%; and the automatic magnification mode is set. At that time, main CPU 202 sets the preset amounts of counter 210 and counter 212 through line L1 and line L2 (step ST 2). The preset amount of counter 210 is 30 seconds, and the preset amount of counter 212 is 60 seconds. Namely, if original D is not on original table 6 and 30 seconds have elapsed after the last operation of control panel 140, main CPU 202 changes the copying status from a voluntary status to the standard status. When 60 seconds have elapsed even if original D is present on original table 6, main CPU 202 changes the copying status from a voluntary status to the standard status. Any operator may set an original D in the proper position on original table 6. If no operation has been performed within 60 seconds, it is assumed that the operator forgot to remove the original D.

After setting the preset amount, main CPU 202 checks whether any key on control panel 140 has been operated by an operator (step ST 3). When control panel 140 is operated, panel CPU 240 transmits a signal corresponding to the operation. Thus, main CPU 202 checks this signal. If main CPU 202 determines that a key is operated, then main CPU 202 checks whether copy key 142 is depressed (step ST 4). If main CPU 202 determines that a key other than copy key 142 has been operated, then main CPU 202 turns off the operating counter and sets the preset amounts in counters 210 and 212 (step ST 5). Namely, the counting amounts of counter 210 and counter 212 are returned to the preset amount every time a key is depressed. Subsequently, main CPU 202 changes the copying status corresponding the operation (step ST 6).

On the other hand, if main CPU 202 determines that copy key 142 is depressed in step ST 4, then main CPU 202 turns off the operating counter and sets the preset amount in counters 210 and 212 (step ST 7). After that, main CPU 202 performs the copying operation through printer CPU 230 as described above (step ST 8).

After step ST 6 or step ST 8, main CPU 202 checks whether second sensor 102 detects original D (step ST 9). When second sensor 102 detects original D, scanner CPU 220 transmits a signal "1" to main CPU 202 through bus 248. On the contrary, when second sensor 102 does not detect original D, scanner CPU 220 transmits a signal "0" to main CPU 202 through bus 248. If main CPU 202 determines that second sensor 102 detects an original D, main CPU 202 turns on counter 212 through line L3, change-over circuit 214, and line L4 (step ST 10). If main CPU 202 determines that second sensor 102 does not detect an original D, main CPU 202 turns on counter 210 through line L3, change-over circuit 214, and line L5 (step ST 11).

After step ST 10 or step ST 11, main CPU 202 checks whether the signal from second sensor 102 has been changed (step ST 12). In other words, main CPU 202 monitors whether an original D has been placed on or removed from original table 6.

If main CPU 202 determines that the signal from second sensor 102 has been changed, main CPU 202 turns off one counter which is turned on in step ST 10 or step ST 11, and turns on the other counter which is not turned on in step ST 10 or step ST 11 through change-over circuit 214 (step ST 13).

If main CPU 202 determines that the signal from second sensor 102 has not been changed or after step ST 13, main CPU 202 checks whether either counter 210 or counter 212 has counted the preset amount (step ST 14). After either counter 210 or counter 212 has counted the preset amount, the predetermined signal is transmitted to main CPU 202 through line L6.

If main CPU 202 determines that neither counter 210 nor counter 212 has counted the preset amount, main CPU 202 checks whether any keys on control panel 140 are operated by an operator (step ST 15). If main CPU 202 determines that any keys are not operated, the flow returns to step ST 12. If main CPU 202 determines that some keys are operated, the flow returns to step ST 4.

If main CPU 202 determines in step ST 14 that either counter 210 or counter 212 has counted the preset amount, the flow returns to step ST 1 to set the standard status.

In this way, when original D is present on original table 6, the time period for resetting the copying status to the standard status is longer than that for resetting the copying status when an original D is absent.

Figure 6:
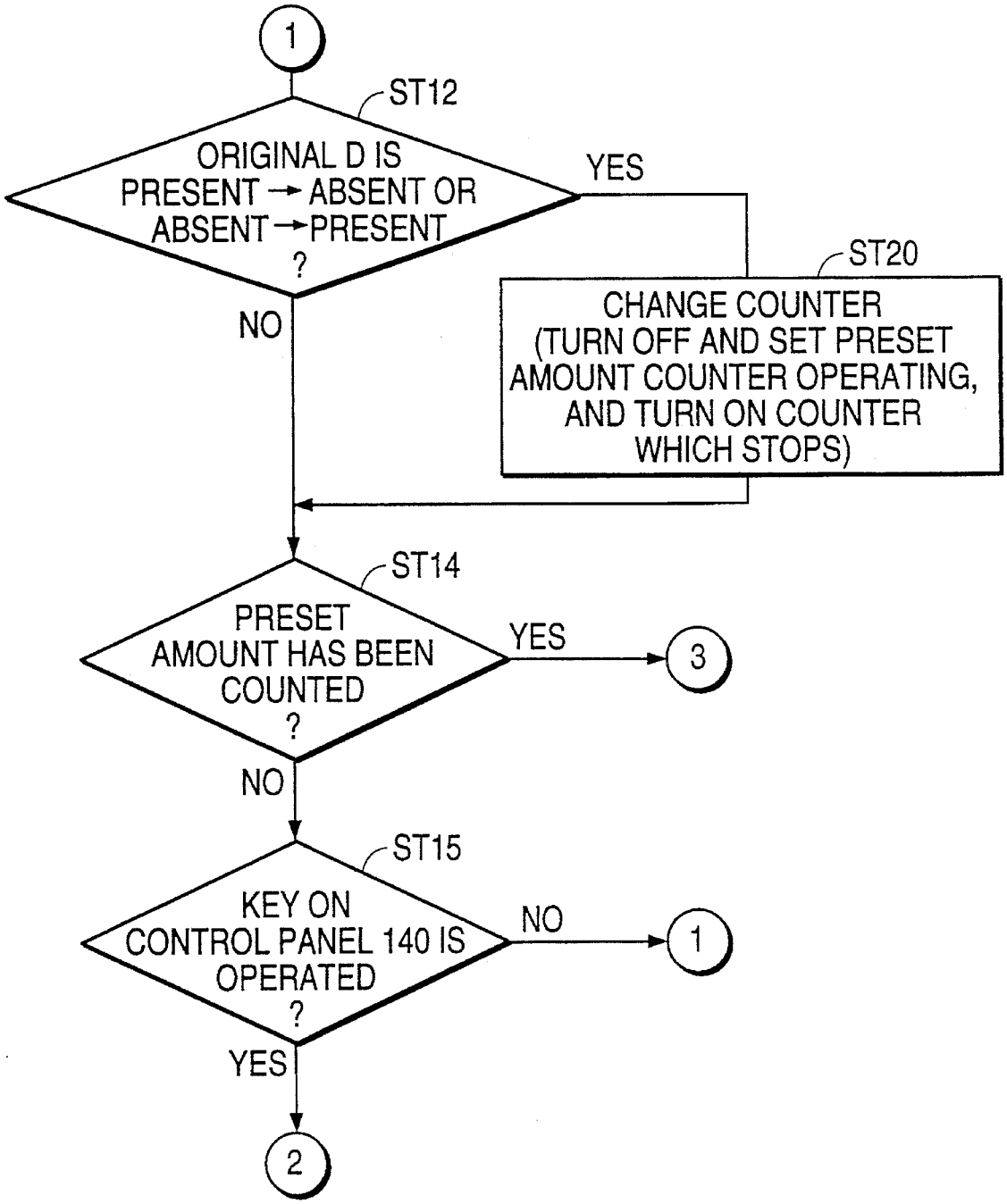
FIG. 6 is a flow chart for illustrating the operation of a second embodiment of the control system shown in FIG. 4.

FIG. 6 shows a second embodiment of the operation of control system 200. In this embodiment, if main CPU 202 determines in step ST 12 that the signal from second sensor 102 has been changed, main CPU 202 turns off one counter which is turned on in step ST 10 or step ST 11. Also main CPU 202 sets counter 210 to the preset amount (step ST 20). Thus, the counter is initialized every time the signal has been changed. On the other hand, main CPU 202 turns on the other counter which is not turned on in step ST 10 or step ST 11 through change-over circuit 214. In this case, when the other counter is turned on, the counting amount of the other counter is the preset amount.

Figure 7A:
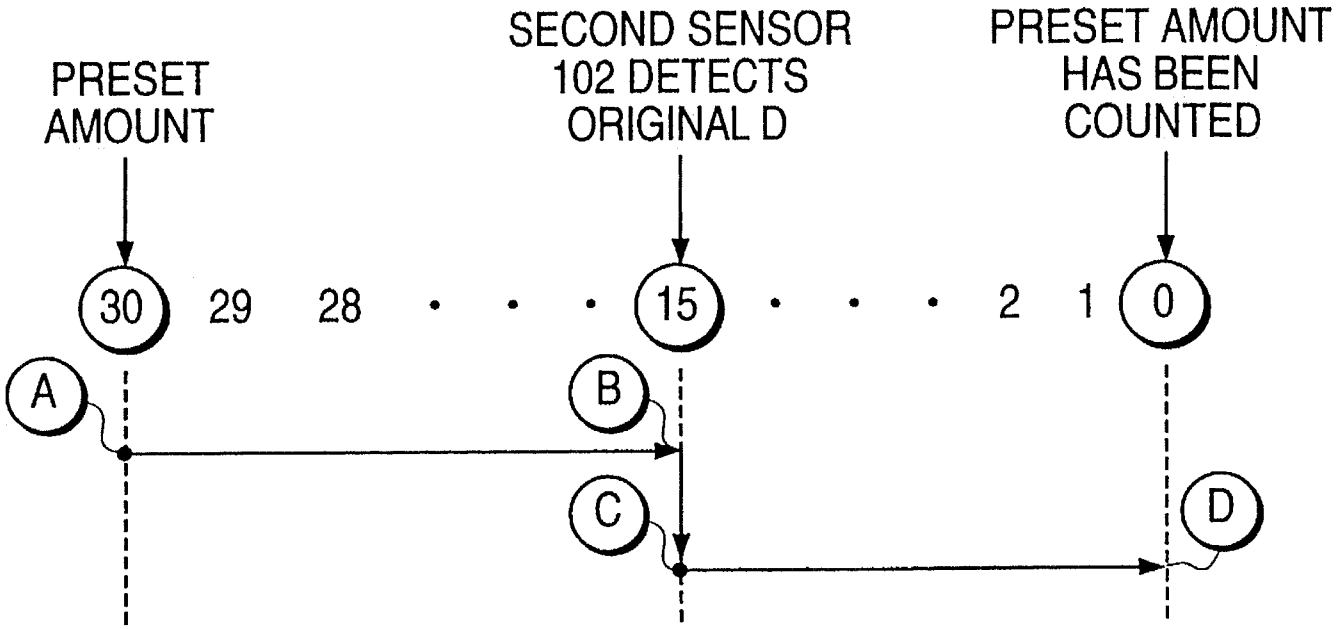
FIGS. 7(*a*) and 7(*b*) are a timing diagram which shows the difference between the operation of the first embodiment and the operation of the second embodiment.
Figure 7B:
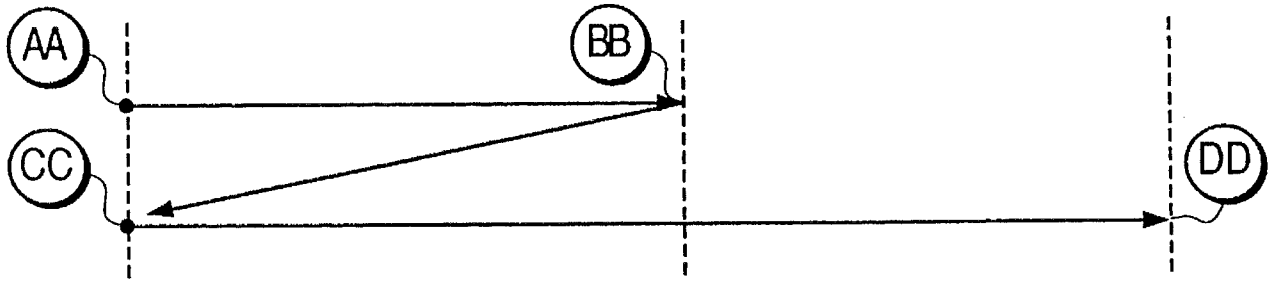

The difference between the first embodiment and the second embodiment is described in FIGS. 7(*a*) and 7(*b*). FIG. 7(*a*) shows the operation of counter 210 in the first embodiment, and FIG. 7(*b*) shows the operation of counter 212 in the second embodiment.

First, counter 210 is set to the preset amount in step ST 2 of the first embodiment, and starts counting in step ST 11 (point A). Then, when original D is detected by second sensor 102 in step ST 12, counter 210 is turned off in step ST 13 (point B). After that, when the original is taken off original table 6 in step ST 12, counter 210 is turned on in step ST 13 again (point C). Finally, when counter 210 has counted the preset amount in step ST 14, counter 210 outputs the predetermined signal to main CPU 202 (point D).

On the contrary, counter 210 operates in the second embodiment as follows. First, counter 210 is set to the preset amount in step ST 2, and starts counting in step ST 11 (point AA). Then, when original D is detected by second sensor 102 in step ST 12, counter 210 is turned off in step ST 20 (point BB), and is set to the preset amount (point CC). After that, when the original is taken off the original table 6 in step ST 12, counter 210 is turned on in step ST 20 again (point CC). Finally, when counter 210 has counted the preset amount in step ST 14, counter 210 outputs the predetermined signal to main CPU 202 (point DD). In this case, the counting amount of the second embodiment is a time period X longer than that of the first embodiment.

Figure 8:
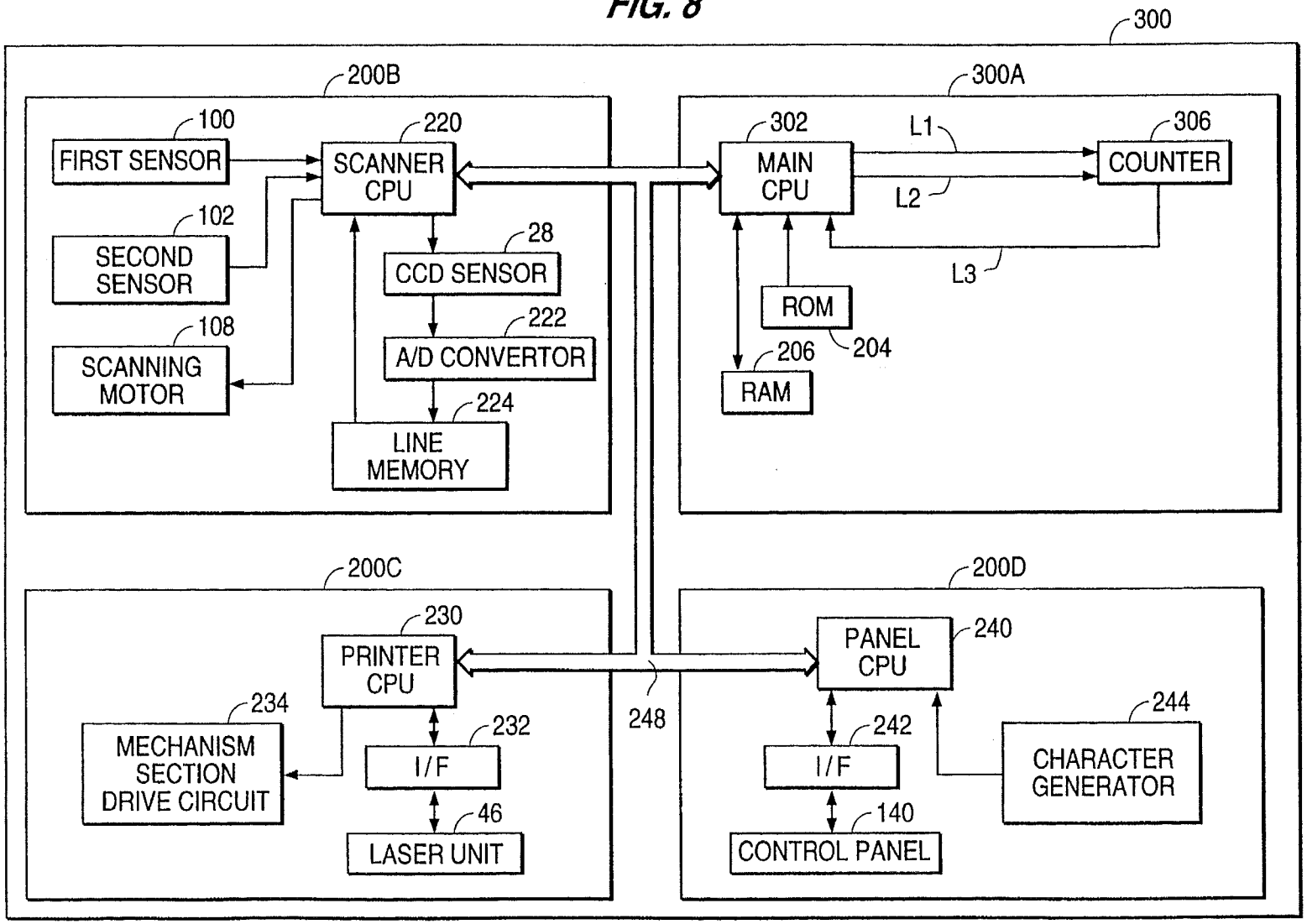
FIG. 8 is a diagram showing a control system of a third embodiment.

FIG. 8 shows a third embodiment in relationship with a control system of the copying machine of the invention. In this embodiment, a main control section has only one counter in a timer and does not have a second counter and a change-over circuit. While second sensor 102 detects original D, a main CPU does not change the copying status and the copying mode to the standard status.

As shown in FIG. 8, a control system 300 includes a main control section 300A. Main control section 300A includes a main CPU 302. Main CPU 302 connects to a timer 304. Timer 304 determines when a predetermined time has elapsed after the last setting operation of control panel 140, and outputs a signal to main CPU 302. When main CPU 302 receives the signal, main CPU 302 changes the copying status and the copying mode to the standard status. Timer 304 includes a counter 306, and lines L11, L12, and L13 for transmitting signals. The other elements in control system 300 are the same as those in control system 200 of the first embodiment.

Figure 9A:
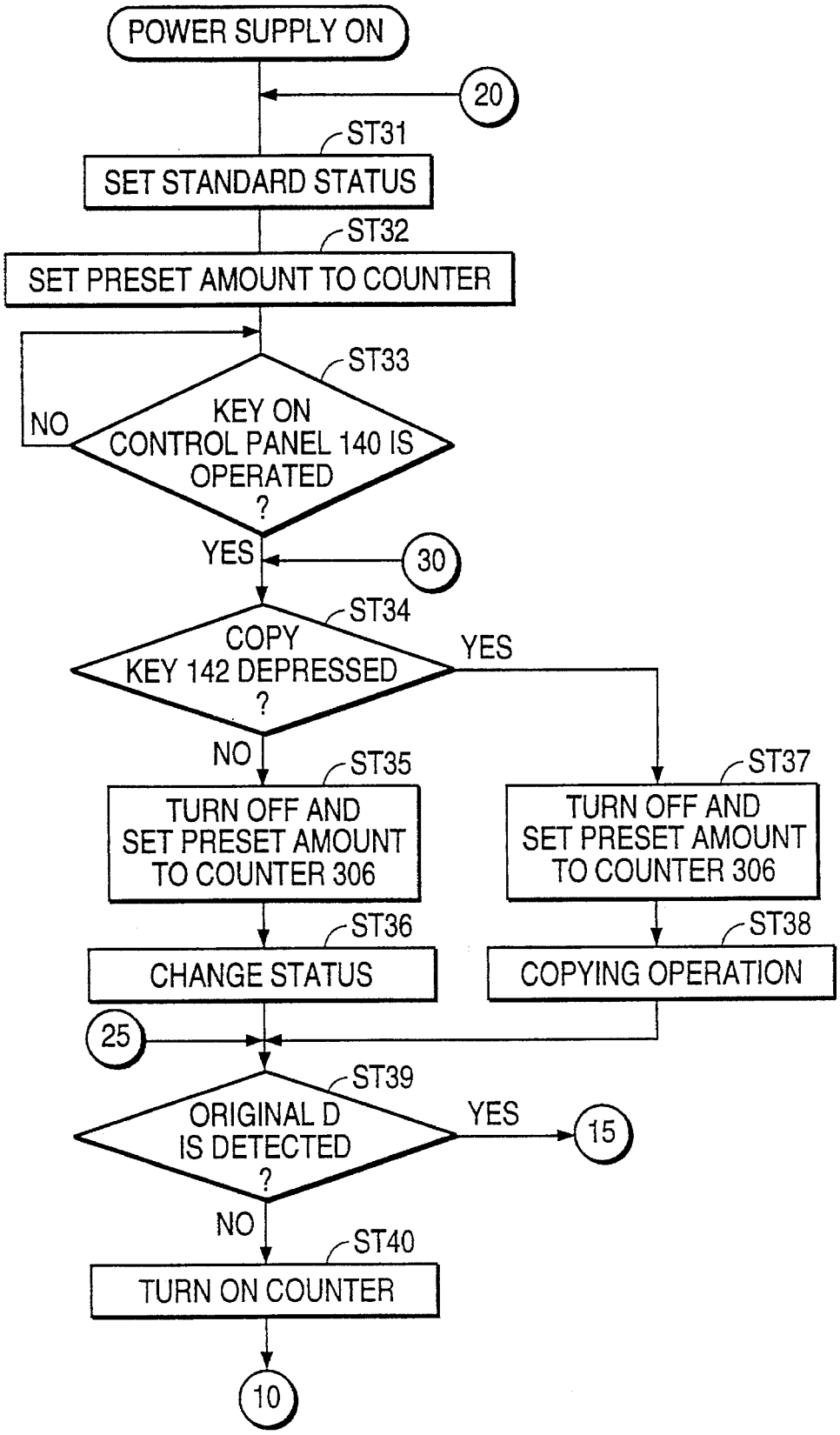
FIGS. 9(*a*) and 9(*b*) are flow charts for illustrating the operation of the control system shown in FIG. 8.
Figure 9B:
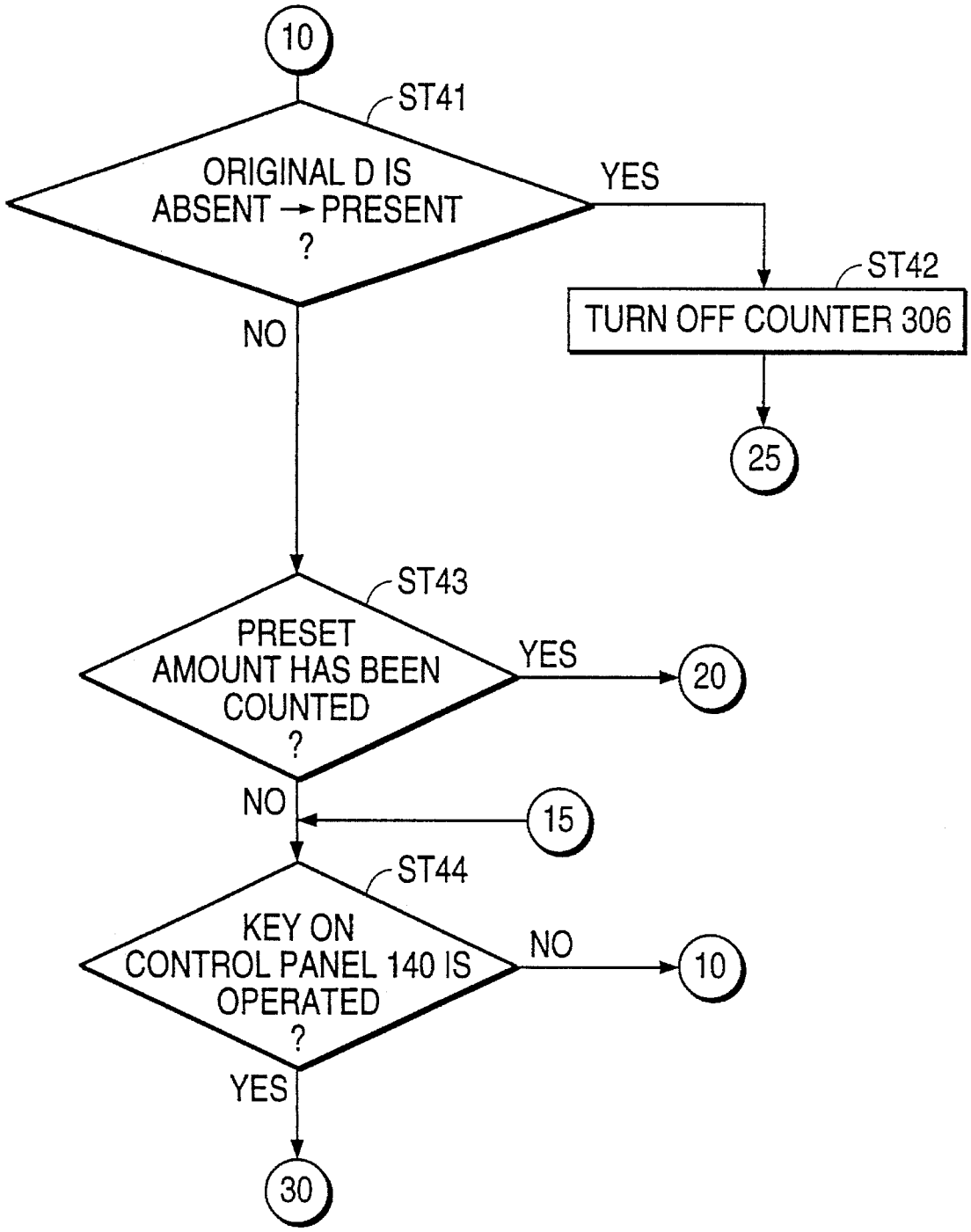

An operation of control system 300 will be described below with reference to flow charts shown in FIGS. 9(*a*) and 9(*b*).

When a power supply (not shown) is turned on, main CPU 302 sets the standard status (step ST 31). After that main CPU 302 sets a preset amount in counter 306 through line L11 (step ST 32). The preset amount is 30 seconds. Subsequently, main CPU 302 checks whether any key on control panel 140 is operated by an operator (step ST 33). If main CPU 302 determines that the key is operated, then main CPU 302 checks whether copy key 142 is depressed (step ST 34). If main CPU 302 determines that a key other than the copy key 142 is operated, then main CPU 302 turns off counter 306 if it is operating, and sets the preset amount to counter 306 (step ST 35). Namely, the counting amount of counter 306 is returned to the preset amount every time some key is depressed. Subsequently, main CPU 302 changes the copying status corresponding the operation (step ST 36).

On the other hand, if main CPU 302 determines that copy key 142 is depressed in step ST 34, then main CPU 302 turns off counter 306 if it is operating, and sets the preset amount to counter 306 (step ST 37). After that, main CPU 302 performs the copying operation through printer CPU 230 as described above (step ST 38).

After step ST 36 or step ST 38, main CPU 302 checks whether second sensor 102 detects original D (step ST 39). If main CPU 302 determines that the second sensor 102 detects an original D, the flow skips to step ST 15.

If main CPU 302 determines that second sensor 102 does not detect original D, main CPU 302 turns on counter 306 through line L12 (step ST 40).

After step ST 40, main CPU 302 checks whether the signal from second sensor 102 has been changed from "0", which means the absence of original D, to "1", which means the presence of original D (step ST 41).

If main CPU 302 determines that the signal from second sensor 102 has been changed from "0" to "1" main CPU 302 turns off counter 306 (step ST 42). If main CPU 302 determines that the signal from second sensor 102 has not been changed or after step ST 42, main CPU 302 checks whether counter 306 has counted the preset amount (step ST 43). After counter 306 has counted the preset amount, the predetermined signal is transmitted to main CPU 302 through line L13. If main CPU 302 determines that counter 306 has not counted the preset amount, main CPU 302 checks whether any keys on control panel 140 are operated by an operator (step ST 44). If main CPU 302 determines that no keys are operated, the flow returns to step ST 41. If main CPU 302 determines that some keys are operated, the flow returns to step ST 34.

If main CPU 202 determines in step ST 43 that counter 306 has counted the preset amount, the flow returns to step ST 31 to set the standard status.

In this way, when original D is present on original table 6, main CPU 302 does not change the copying status and the copying mode to the standard status.

Figure 10:
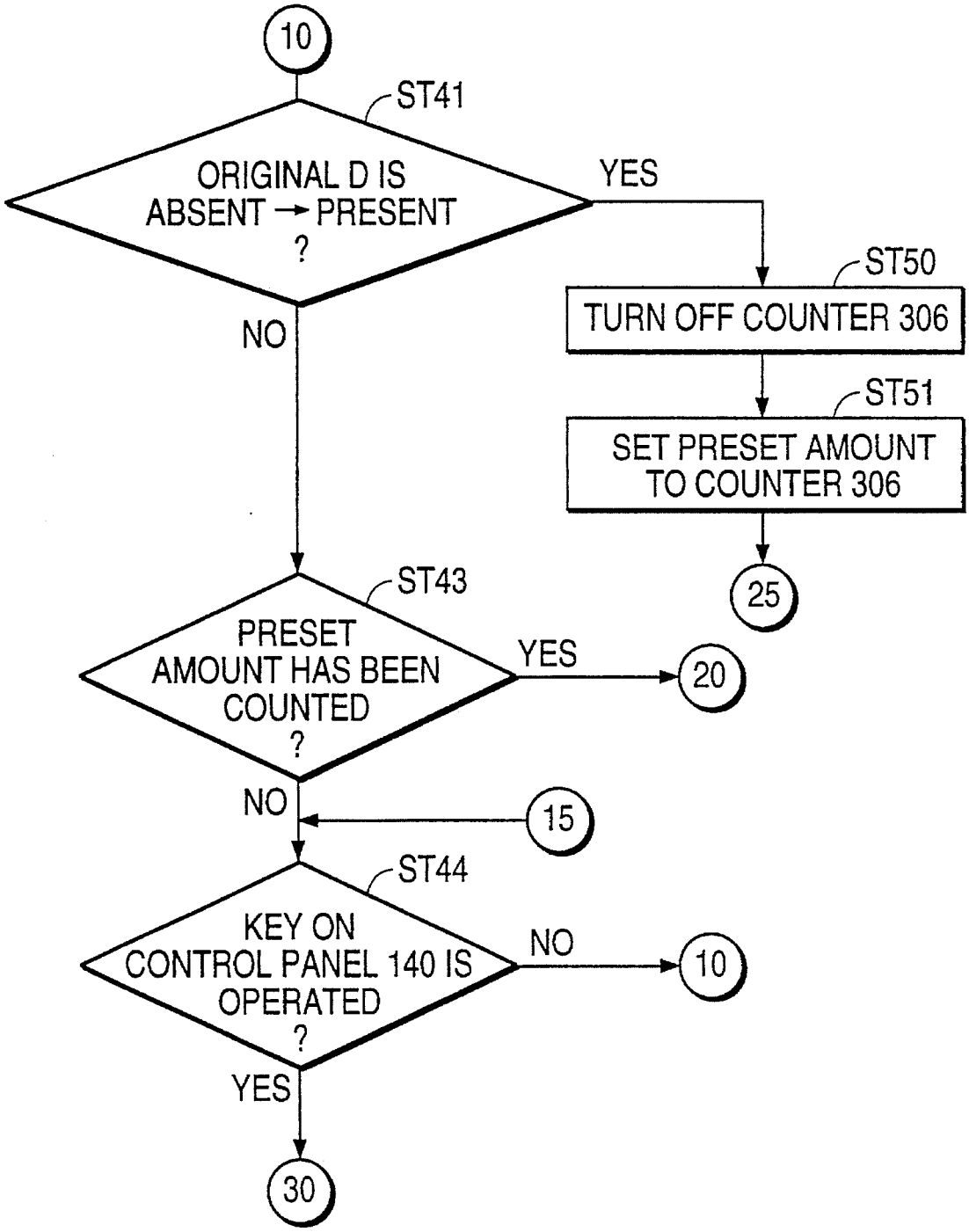
FIG. 10 is a flow chart for illustrating the operation of a fourth embodiment of the control system shown in FIG. 8.

FIG. 10 shows a fourth embodiment in relationship with the operation of control system 300. In this embodiment, if main CPU 302 determines in step ST 41 that the signal from second sensor 102 has been changed from "0" to "1" main CPU 302 turns off counter 306 (step ST 50). Also, main CPU 302 sets counter 306 to the preset amount (step ST 51).

Thus, counter 306 is initialized every time the signal has been changed from "0" to "1".

Figure 11:
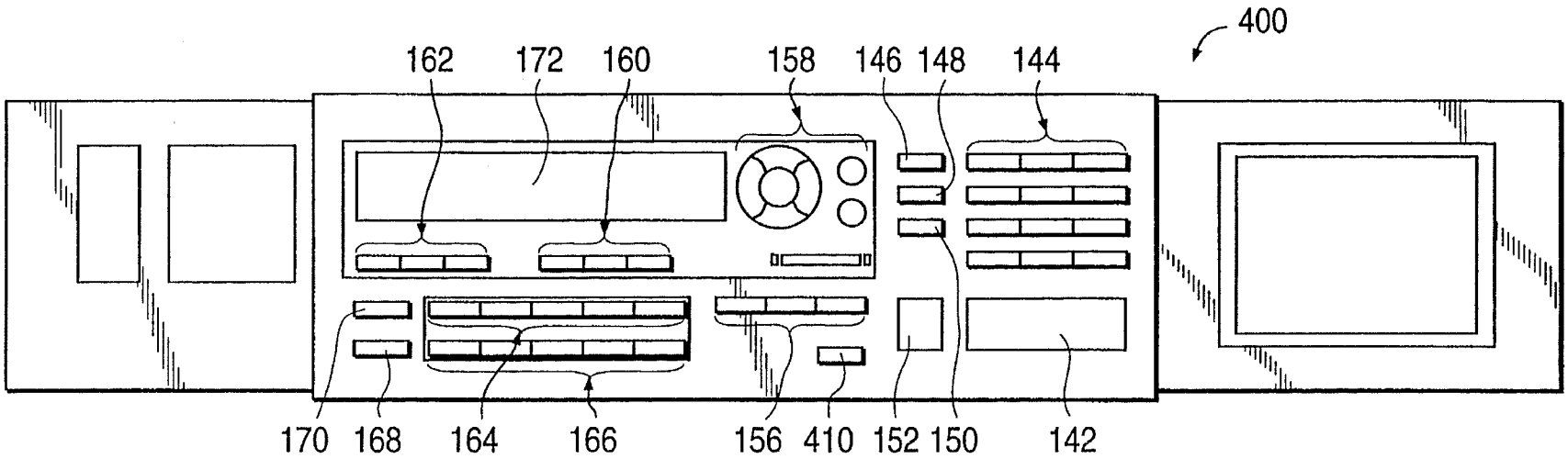
FIG. 11 is a plan view of a control panel of a fifth embodiment.

FIG. 11 shows a fifth embodiment in relationship with a control panel 400 of the copying machine of the invention. Control panel 400 has a prohibit key 410 on the left side of clear/stop key 152. When prohibit key 410 is depressed once, copying machine 2 is set in a prohibit mode from a normal mode. In the prohibit mode, counter 210 and counter 212 or counter 306 do not work. Thus, the copying status or the copying mode is not automatically changed to the standard status regardless of the time elapsed. If prohibit key 410 is depressed again, copying machine 2 is returned to the normal mode. The other keys on control panel 400 are the same as those on control panel 140.

Figure 12A:
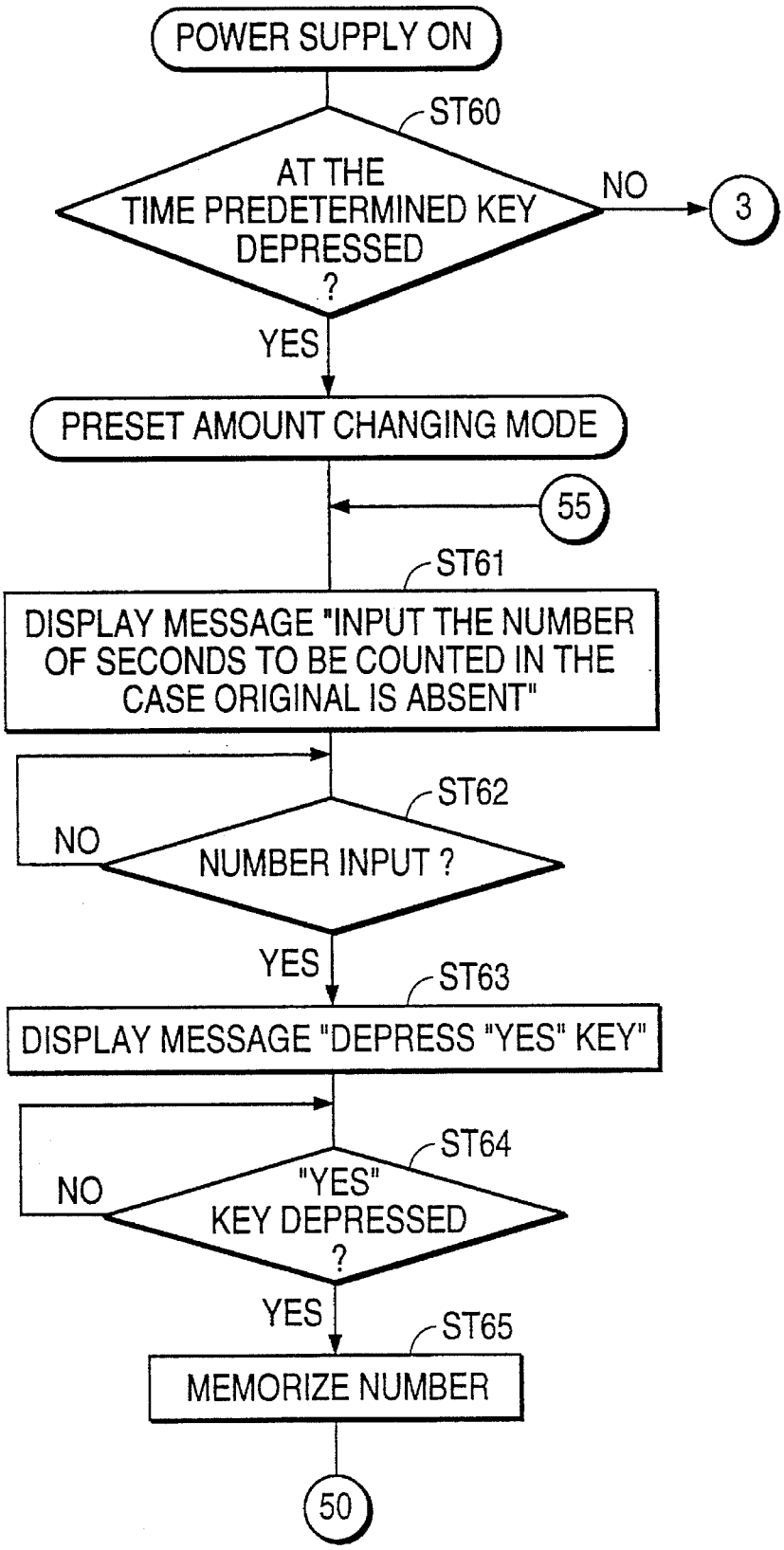
FIGS. 12(*a*) and 12(*b*) are flow charts for illustrating the operation of a sixth embodiment of the control system shown in FIG. 4.
Figure 12B:
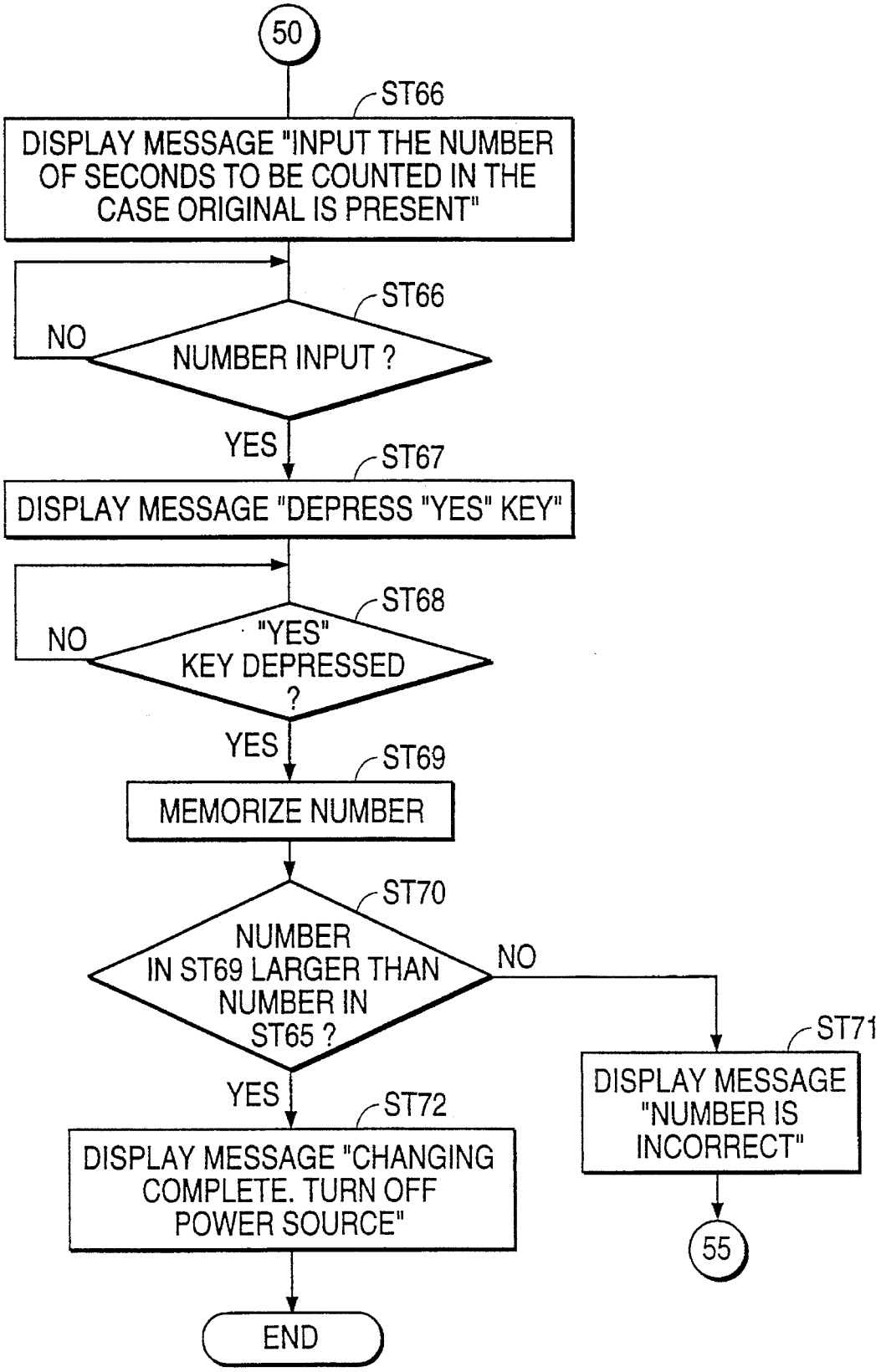

FIGS. 12(*a*) and 12(*b*) show a sixth embodiment in relationship with the operation of the control system of this invention. In this embodiment, the preset amounts for the counters are set voluntarily, and the operation for setting the preset amount will be described. This embodiment is applied to control system 200 in the first embodiment.

When the power supply is turned on, main CPU 202 checks whether a predetermined key is depressed (step ST 60). In this embodiment, the predetermined key is a "4" key of keys 144 on control panel 140. If main CPU 202 determines that the "4" key is not depressed at that time, then the flow skips to step ST 1 in FIG. 5(*a*). On the contrary, if main CPU 202 determines that the "4" key is depressed at that time, a preset amount changing mode is entered, and main CPU 202 makes display section 172 display a message "INPUT THE NUMBER OF SECONDS TO BE COUNTED IN THE CASE THE ORIGINAL IS ABSENT" through panel CPU 240 (step ST 61). Then, main CPU 202 checks whether the number of seconds has been input by keys 144 until the number of seconds is input (step ST 62). If main CPU 202 determines that the number of seconds has been input, main CPU 202 makes display section 172 display a message "DEPRESS 'YES' KEY" (step ST 63), and checks whether the "YES" key in operation guide keys 160 is depressed until the "YES" key is depressed (step ST 64). If main CPU 202 determines that the "YES" key is depressed, main CPU 202 stores data corresponding to the number of seconds into RAM 206 (step ST 65). For example, when the "4" key, a "5" key, and the "YES" key are depressed in order, main CPU 202 determines that the input data represents "45 seconds". This data corresponds to the preset amount of counter 210.

After that, main CPU 202 makes display section 172 display a message "INPUT THE NUMBER OF SECONDS TO BE COUNTED IN THE CASE THE ORIGINAL IS PRESENT" (step ST 66). Next, main CPU 202 checks whether the number of seconds has been input by keys 144 until the number of seconds is input (step ST 66). If main CPU 202 determines that the number of seconds has been input, main CPU 202 makes display section 172 display a message "DEPRESS 'YES' KEY" (step ST 67), and checks whether the "YES" key is depressed until the "YES" key is depressed (step ST 68). If main CPU 202 determines that the "YES" key is depressed, main CPU 202 stores data corresponding to the number of seconds into RAM 206 (step ST 69). For example, when a "1" key, a "2" key, a "0" key, and the "YES" key are depressed in order, main CPU 202 determines that the input data represents "120 seconds". This data corresponds to the preset amount of counter 212. Then, main CPU 202 checks whether the number stored in step ST 65 is larger than the number stored in step ST 69 (step ST 70). If main CPU 202 determines that the number stored in step ST 65 is not larger than the number stored in step ST 69, then main CPU 202 makes display section 172 display a message "NUMBER IS INCORRECT" (step ST 71) and returns to step ST 61. If main CPU 202 determines that the number stored in step ST 65 is larger than the number stored in step ST 69, main CPU 202 makes display section 172 display a message "CHANGING COMPLETE. TURN OFF POWER SOURCE" (step ST 70). When the power supply is turned off, copying machine 2 escapes from the preset amount changing mode. Control system 200 uses the input data since next time the power supply is turned on.

The present invention may be embodied in other specific forms without departing from the spirit or essential characteristics thereof. The present embodiments are therefore to be considered in all respects as illustrative and not restrictive. The scope of the present invention is to be determined by the appended claims rather than by the foregoing description, and all changes which come within the meaning and range of equivalency of the claims are therefore intended to be embraced therein.

What is claimed is:

1. An image-forming apparatus for forming an image at one of a plurality of image-forming conditions including a standard condition, comprising:

means for forming an image on an image-bearing member in one of a plurality of image-forming conditions;

means for setting at a voluntary condition which is one of the image-forming conditions;

means for changing the voluntary condition to the standard condition when a predetermined time has elapsed after the setting; and means for preventing a change from the voluntary condition to the standard condition.

2. An image-forming apparatus according to claim 1, wherein the preventing means includes a prohibit key on a control panel.

3. An image-forming apparatus for forming an image at one of a plurality of image-forming conditions including a standard condition, comprising:

means for forming an image on an image-bearing member corresponding to an original positioned at an image-reading position, the image-forming means forming the image in one of a plurality of image-forming conditions;

means for setting a voluntary condition which is one of the image-forming conditions;

means for changing the voluntary condition to the standard condition when a predetermined time has elapsed after the setting;

means for detecting that an original is present at the image-reading position; and means for preventing a change from the voluntary condition to the standard condition when an original is detected at the image reading position by said detecting means.

4. An image-forming apparatus according to claim 3, wherein the changing means includes a first counter for counting the predetermined time period, the preventing means includes a second counter for counting a second time period longer than the predetermined time period, and a change-over circuit responsive to said means for detecting for changing from the first counter to the second counter corresponding to the detection.

5. An image-forming apparatus according to claim 4, wherein said detecting means detects when an original is absent from said image reading position as well as when an original is present at said image reading position and further comprising a controller for stopping the first counter when the detecting means detects that an original is present, and restarting the first counter from the stopped counting amount when the detecting means detects that an original is absent.

6. An image-forming apparatus according to claim 4, wherein said detecting means detects when an original is absent from said image reading position as well as when an original is present at said image reading position and further comprising a controller for stopping the second counter when the detecting means detects that an original is absent, and restarting the second counter from the stopped counting amount when the detecting means detects that an original is present.

7. An image-forming apparatus according to claim 4, wherein said detecting means detects when an original is absent from said image reading position as well as when an original is present at said image reading position and further comprising a controller for stopping the first counter when the detecting means detects that an original is present, and restarting the first counter from the preset amount when the detecting means detects that an original is absent.

8. An image-forming apparatus according to claim 4, wherein said detecting means detects when an original is absent from said image reading position as well as when an original is present at said image reading position and further comprising a controller for stopping the second counter when the detecting means detects that an original is absent, and restarting the second counter from the preset amount when the detecting means detects that an original is present.

9. An image-forming apparatus according to claim 4, further comprising an input device for inputting a preset amount to be the predetermined time period which the first counter counts and a preset amount to be the second time period which the second counter counts.

10. An image-forming apparatus according to claim 3, wherein the changing means includes a counter for counting the predetermined time period, the preventing means includes a controller for interrupting the operation of the first counter when the detecting means detects that an original is present.

11. An image-forming apparatus according to claim 10, wherein said detecting means detects when an original is absent from said image reading position as well as when an original is present at said image reading position, and wherein the controller includes a subcontroller for stopping the counter when the detecting means detects that an original is present, and restarting the counter from the stopped counting amount when the detecting means detects that an original is absent.

12. An image-forming apparatus according to claim 10, wherein the controller includes a sub-controller for stopping the counter when the detecting means detects that an original is present, and restarting the counter from the preset amount when the detecting means detects that an original is absent.

13. An image-forming apparatus for forming an image at one of a plurality of image-forming conditions including a standard condition, comprising:

an image-forming unit;

input keys coupled to the image-forming unit;

a controller coupled to the input keys, the controller determines one of the image-forming conditions corresponding to the operation of the input keys;

a timer coupled to the controller, the timer outputting a predetermined signal when a predetermined time has elapsed after the operation of an input key so as to make the controller change the image-forming condition to the standard condition; and a prohibit key coupled to the controller, to prevent the controller from changing to the standard condition.

14. An image-forming apparatus for forming an image at one of a plurality of image-forming conditions including a standard condition, comprising:

an image-forming unit having an image-reading position at which an original is placed;

input keys coupled to the image-forming unit;

a controller coupled to the input keys, the controller determines one of the image-forming conditions corresponding to the operation of the input keys;

a first counter coupled to the controller, the first counter outputting a predetermined signal when a predetermined time has elapsed after the operation of an input key so as to make the controller change the image-forming condition to the standard condition; and a sensor positioned near the image-reading position and coupled to the controller, the sensor outputting a signal when the original is at the image-reading position so as to prevent operation of the first counter.

15. An image-forming apparatus according to claim 14, further comprising a second counter coupled to the controller, the second counter outputting the predetermined signal when a second time period elapsed after the operation of an input key so as to make the controller change the image-forming condition to the standard condition; and a change-over circuit coupled to the controller, the first counter, and the second counter, the change-over circuit makes the first counter operate when the sensor outputs the signal and makes the second counter operate when the sensor does not output the signal.

16. An image-forming method for forming an image corresponding to an original positioned at an image-reading position at one of a plurality of image-forming conditions including a standard condition, comprising the steps of:

setting at a voluntary condition which is one of the image-forming conditions;

changing the voluntary condition to the standard condition when a predetermined time has elapsed after the setting;

preventing the image forming condition from changing to the standard condition at least while the original is positioned at the image-reading position; and forming an image on an image-bearing member at one of said plurality of image-forming conditions.

* * * * *